US007897694B2

(12) United States Patent
Rajagopalan et al.

(10) Patent No.: US 7,897,694 B2
(45) Date of Patent: Mar. 1, 2011

(54) POLYACRYLATE RUBBER COMPOSITIONS FOR GOLF BALLS

(75) Inventors: Murali Rajagopalan, Fairhaven, MA (US); Michael J. Sullivan, Fairhaven, MA (US)

(73) Assignee: Acushnet Company, Fairhaven, MA (US)

( * ) Notice: Subject to any disclaimer, the term of this patent is extended or adjusted under 35 U.S.C. 154(b) by 390 days.

(21) Appl. No.: 12/003,286

(22) Filed: Dec. 21, 2007

(65) Prior Publication Data

US 2009/0163297 A1 Jun. 25, 2009

(51) Int. Cl.

| | |
|---|---|
| ***A63B 37/00*** | (2006.01) |
| ***A63B 37/06*** | (2006.01) |
| ***C08J 3/24*** | (2006.01) |
| ***C08L 33/08*** | (2006.01) |

(52) U.S. Cl. ..... 525/328.9; 525/194; 525/259; 525/330.3; 525/330.5; 526/320; 526/328; 526/329.5; 473/371; 473/377

(58) Field of Classification Search ..... None
See application file for complete search history.

(56) References Cited

U.S. PATENT DOCUMENTS

| | | | | |
|---|---|---|---|---|
| 4,560,168 | A | 12/1985 | Aoyama | 473/379 |
| 4,925,193 | A | 5/1990 | Melvin et al. | 473/379 |
| 4,960,281 | A | 10/1990 | Aoyama | 473/380 |
| 5,248,878 | A | 9/1993 | Ihara | 219/121.69 |
| 5,249,804 | A | 10/1993 | Sanchez | 473/379 |
| 5,280,488 | A | 1/1994 | Glover et al. | 714/784 |
| 5,334,673 | A | 8/1994 | Wu | 473/378 |
| 5,484,870 | A | 1/1996 | Wu | 528/28 |
| 5,562,552 | A | 10/1996 | Thurman | 473/379 |
| 5,688,181 | A | 11/1997 | Albert | 473/61 |
| 5,688,191 | A | 11/1997 | Cavallaro et al. | 473/373 |
| 5,713,801 | A | 2/1998 | Aoyama | 473/354 |
| 5,803,831 | A | 9/1998 | Sullivan et al. | 473/374 |
| 5,849,168 | A | 12/1998 | Lutz | 264/255 |
| 5,885,172 | A | 3/1999 | Hebert et al. | 473/354 |
| 5,919,100 | A | 7/1999 | Boehm et al. | 473/354 |
| 5,957,787 | A | 9/1999 | Hwang | 473/379 |
| 5,965,669 | A | 10/1999 | Cavallaro et al. | 525/221 |
| 5,981,654 | A | 11/1999 | Rajagopalan | 525/66 |
| 5,981,658 | A | 11/1999 | Rajagopalan et al. | 525/72 |
| 6,056,842 | A | 5/2000 | Dalton et al. | 156/243 |
| 6,075,223 | A | 6/2000 | Harrison | 219/121.85 |
| 6,099,415 | A | 8/2000 | Lutz | 473/357 |
| 6,129,881 | A | 10/2000 | Puniello | 264/278 |
| 6,149,535 | A | 11/2000 | Bissonnette et al. | 473/354 |
| 6,180,040 | B1 | 1/2001 | Ladd et al. | 264/248 |
| 6,180,722 | B1 | 1/2001 | Dalton et al. | 525/193 |
| 6,207,784 | B1 | 3/2001 | Rajagopalan | 528/71 |
| 6,213,898 | B1 | 4/2001 | Ogg | 473/383 |
| 6,235,230 | B1 | 5/2001 | Puniello | 264/278 |
| 6,248,804 | B1 | 6/2001 | Lutz | 523/160 |
| 6,290,615 | B1 | 9/2001 | Ogg | 473/378 |
| 6,315,915 | B1 | 11/2001 | Hebert et al. | 216/67 |
| 6,338,684 | B1 | 1/2002 | Winfield et al. | 473/378 |
| 6,358,161 | B1 | 3/2002 | Aoyama | 473/383 |
| 6,379,138 | B1 | 4/2002 | Puniello et al. | 425/116 |
| 6,383,092 | B1 | 5/2002 | Ogg | 473/378 |
| 6,409,615 | B1 | 6/2002 | McGuire et al. | 473/383 |
| 6,462,303 | B1 | 10/2002 | Brown | 219/121.69 |
| 6,494,795 | B2 | 12/2002 | Sullivan | 473/372 |
| 6,500,495 | B2 | 12/2002 | Lutz | 427/500 |
| 6,705,959 | B2 | 3/2004 | Morgan et al. | 473/383 |
| 7,033,286 | B2 | 4/2006 | Morgan et al. | 473/383 |
| 7,041,769 | B2 | 5/2006 | Wu et al. | 528/61 |
| 7,399,239 | B2 * | 7/2008 | Rajagopalan et al. | 473/351 |
| 2001/0005699 | A1 | 6/2001 | Morgan | |
| 2001/0009310 | A1 | 7/2001 | Hebert | |
| 2001/0018375 | A1 | 8/2001 | Hayashi | |
| 2001/0019971 | A1 | 9/2001 | Hayashi | |
| 2002/0025862 | A1 | 2/2002 | Sullivan | |
| 2002/0028885 | A1 | 3/2002 | Sullivan | |
| 2002/0151380 | A1 | 10/2002 | Sullivan | |
| 2002/0160859 | A1 | 10/2002 | Morgan | |
| 2002/0160862 | A1 | 10/2002 | Morgan | |
| 2003/0079615 | A1 | 5/2003 | Pattle | |
| 2003/0082358 | A1 | 5/2003 | Wenstrup | |
| 2003/0096936 | A1 | 5/2003 | Wu | |
| 2003/0106442 | A1 | 6/2003 | Gosetti | |
| 2003/0114255 | A1 | 6/2003 | Dalton | |
| 2003/0119989 | A1 | 6/2003 | Ladd | |
| 2003/0125134 | A1 | 7/2003 | Nardacci | |
| 2003/0232666 | A1 | 12/2003 | Sullivan | |
| 2004/0110905 | A1 * | 6/2004 | Kubota et al. | 525/329.7 |
| 2005/0227786 | A1 * | 10/2005 | Sullivan et al. | 473/371 |
| 2005/0261424 | A1 * | 11/2005 | Snell et al. | 525/7 |

FOREIGN PATENT DOCUMENTS

| | | | |
|---|---|---|---|
| EP | 1640391 | * | 3/2006 |
| JP | 05214196 | * | 8/1993 |

* cited by examiner

*Primary Examiner*—David Buttner
(74) *Attorney, Agent, or Firm*—Murphy & King, P.C.

(57) ABSTRACT

Golf ball components, such as cores, intermediate layers, and covers, formed with compositions including polyacrylate elastomers cured with peroxide systems, amine-based systems, or a combination thereof.

9 Claims, 2 Drawing Sheets

POLYACRYLATE RUBBER COMPOSITIONS FOR GOLF BALLS

FIELD OF THE INVENTION

The invention relates to golf ball components including polyacrylate rubber compositions. In particular, the present invention is directed to various golf ball components, e.g., golf ball cores and intermediate layers, formed from a peroxide cured polyacrylate rubber composition. In addition, the compositions of the invention may include polyacrylate elastomers cured with amine-based cure systems.

BACKGROUND OF THE INVENTION

Golf ball components are formed from a variety of compositions. For example, golf ball cores, intermediate layers, and covers may be formed from materials ranging from balata to ionomer resin to polyurethane or polyurea. Manufacturers constantly experiment with the different materials for use in the various golf ball layers in order to provide a golf ball that has desirable aerodynamic properties, "soft" feel, and increased durability.

Because the core or center of the golf ball becomes the "engine" of the golf ball when hit with a club head, manufacturers are continually looking to improve this component of the ball. Generally, golf ball cores and/or centers are constructed with a polybutadiene-based rubber composition. As such, these types of compositions are constantly being altered in an effort to balance the desire for a higher coefficient of restitution ("COR") and lower compression, which can ultimately lower the golf ball spin rate, provide better "feel," or both. This is a difficult task, however, given the physical limitations of currently available rubber formulations.

Therefore, there remains a continuing need for core compositions that provide the desired core and finished ball properties. In addition, it would be advantageous to provide a rubber-based composition that removes the heavy reliance on conventional polybutadiene rubbers.

SUMMARY OF THE INVENTION

The present invention is directed to a golf ball including a core and a cover, wherein the core is formed from a composition including: an polyacrylate elastomer; a free radical initiator; and a coagent. In one embodiment, the polyacrylate elastomer includes a $C_{4-8}$ acrylate and a $C_{1-3}$ acrylate. In another embodiment, the polyacrylate elastomer further includes an acrylate with an alkoxyalkyl group having about 2 to about 12 carbon atoms. In still another embodiment, the polyacrylate elastomer includes n-butyl acrylate, methyl acrylate, and methoxyethyl acrylate.

The free radical initiator may include at least one peroxide. In one embodiment, the at least one free radical initiator is selected from the group consisting of di-t-amyl peroxide, tert-amyl peroxy-2-ethylhexyl carbonate, t-amyl peroxyacetate, ethyl 3,3-D(t-amylperoxy)butyrate, 2,2-di-(t-amylperoxy)propane, t-amyl perbenzoate, di(2-t-butyl-peroxyisopropyl)benzene peroxide, 1,1-bis(t-butylperoxy)-3,3,5-trimethylcyclohexane, dicumyl peroxide, di-t-butyl peroxide, 2,5-di-(t-butylperoxy)-2,5-dimethyl hexane, n-butyl-4,4-bis(t-butylperoxy)valerate, lauryl peroxide, benzoyl peroxide, t-butyl hydroperoxide, and mixtures thereof.

In one embodiment, the composition includes about 45 percent to about 75 weight percent $C_{1-3}$ acrylate and about 25 percent to about 55 weight percent $C_{4-8}$ acrylate based on the total weight of the polyacrylate elastomer. In another embodiment, the composition includes about 5 percent to about 30 weight percent $C_{1-3}$ acrylate, about 40 percent to about 70 weight percent $C_{4-8}$ acrylate, and about 20 percent to about 30 weight percent an acrylate with an alkoxyalkyl group having about 2 to about 12 carbon atoms based on the total weight of the polyacrylate elastomer.

The coagent may include a sulfur-containing compound, a multifunctional monomer, a maleimide compound, a quinone compound, a low molecular weight polybutadiene polymer, and mixtures thereof.

The present invention also related to a golf ball including a core and a cover, wherein at least a portion of the golf ball includes a polyacrylate rubber composition includes: a polyacrylate elastomer; and a cure system, wherein the cure system includes a diamine and an accelerator. In one embodiment, the diamine is selected from the group consisting of hexamethylene carbamate, ethylene diamine, methyl isobutyl ketimine, and mixtures thereof. In another embodiment, the accelerator includes di-orthotolyl guanidine, diphenyl guanidine, and mixtures thereof.

In this aspect of the invention, the cure system may include hexamethylene carbamate and at least one of di-orthotolyl guanidine and diphenyl guanidine. In one embodiment, the polyacrylate elastomer includes a $C_{4-8}$ acrylate and a $C_{1-3}$ acrylate. The polyacrylate elastomer may further include an acrylate with an alkoxyalkyl group having about 2 to about 12 carbon atoms.

The present invention is also directed to a golf ball including a core and a cover, wherein at least a portion of the golf ball includes a polyacrylate rubber composition includes: a polyacrylate elastomer; and a cure system, wherein the cure system includes a diamine, a peroxide, and a polybutadiene having a number average molecular weight of about 5000 or less. In this aspect of the invention, the diamine may be selected from the group consisting of hexamethylene carbamate, ethylene diamine, methyl isobutyl ketimine, and mixtures thereof. In addition, the polyacrylate elastomer may include a $C_{4-8}$ acrylate, a $C_{1-3}$ acrylate, and an acrylate with an alkoxyalkyl group having about 2 to about 12 carbon atoms.

Furthermore, the peroxide may be present in an amount of about 1 part to about 5 parts per hundred parts of the composition and the polybutadiene is present in an amount of about 5 parts or less per hundred parts of the composition, and wherein the polybutadiene has a number average molecular weight of about 500 to about 2000.

BRIEF DESCRIPTION OF THE DRAWINGS

Further features and advantages of the invention can be ascertained from the following detailed description that is provided in connection with the drawing(s) described below.

DETAILED DESCRIPTION OF THE INVENTION

Figure 1:
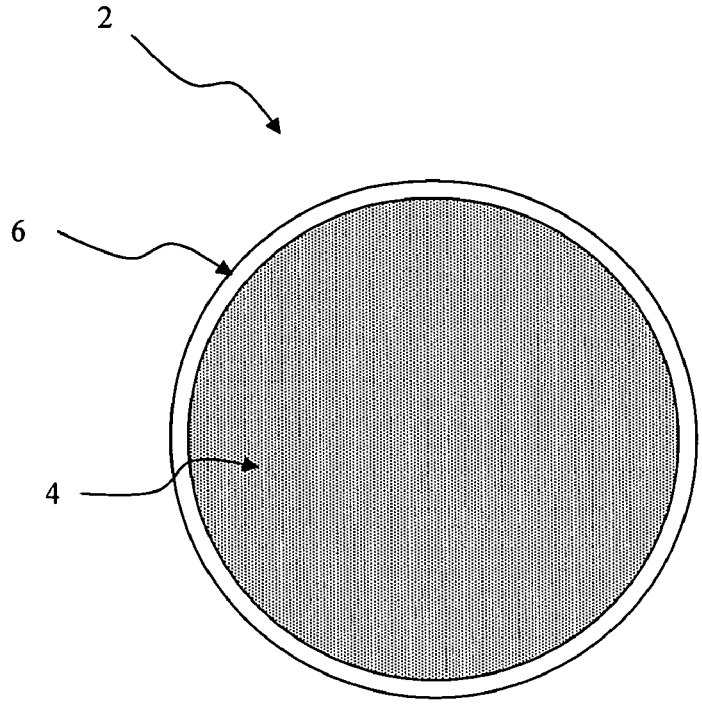
FIG. 1 is a cross-sectional view of a two layer ball, wherein at least a portion of the golf ball is formed from the compositions of the invention.

The present invention contemplates polyacrylate rubber compositions for golf balls. In particular, the polyacrylate rubber compositions of the invention are formed by mixing polyacrylate rubber with a thermally decomposing initiator. In addition, the compositions may include processing aids, antioxidants, and other coagents or promoters. The polyacrylate rubber may be polymerized with electron beam, ultraviolet radiation, or other suitable radiation sources. The presence of acrylate in a rubber-based composition will allow golf ball manufacturers to customize golf balls to have specific hardness values, flexibility properties, abrasion resistance, chemical resistance, crosslink density, and light stability properties.

For example, in one embodiment, the compositions of the invention may have a saturated hydrocarbon or olefin backbone. The backbone provides the resilient portion of the polymer, while the acrylic segment provides crosslinkability. The compositions are then exposed to a thermally decomposing initiator. In another embodiment, the compositions of the invention are based on a copolymer of a saturated hydrocarbon and an acrylate with preferably a free radical initiator and a coagent.

The compositions of the invention may be used in a variety of golf ball constructions, e.g., one-piece, two-piece, or multilayer balls, as well as golf club components, e.g., club head inserts. When included in various golf ball components, e.g., golf ball cores, the compositions of the invention produce golf balls with physical and aerodynamic properties better than or equal to golf balls incorporating conventional rubbers, such as polybutadiene and polyisoprene rubbers. In addition, because butadiene monomers are somewhat limited in supply, manufacturing time and costs may be decreased with the use of the compositions of the present invention as compared to golf ball components typically formed from butadiene rubber.

Compositions of the Invention

As briefly mentioned above, the compositions of the invention may be based on a polyacrylate elastomer that is a copolymer formed by polymerizing a mixture containing saturated hydrocarbons with acrylate functionality. In this aspect of the invention, the system for vulcanization may include a combination of a free radical initiator and a coagent. In addition, the compositions of the invention may be based on a terpolymer of a saturated hydrocarbon chain, an acrylate, and an acidic cure site monomer. In this regard, the system for vulcanization may include a combination of aliphatic diamine salts with organic accelerators.

Polyacrylate Elastomer

Saturated hydrocarbons suitable for use in the compositions function primarily as a rubber or elastic segment. Any saturated hydrocarbon that includes a crosslinkable cure site or a copolymerized reactive cure site, is suitable for use according to the invention. The terms "crosslinkable cure site" or "copolymerized reactive cure site" may encompass a double bond, an acid, an amine, an isocyanate, a hydroxyl, epoxy, a halogen, and combinations thereof. The term "saturated," as used herein, refers to hydrocarbons having all single bonds, i.e., no carbon-carbon double bonds. Nonlimiting examples of suitable saturated hydrocarbon include $C_{1-12}$ alkylenes such as ethylene, propylene, butylene, and the like. In one embodiment, the backbone is ethylene.

One example of a reactive cure site is the incorporation of an acrylate functionality on the saturated hydrocarbon. Any acrylate capable of endcapping a saturated hydrocarbon backbone and, thus, providing acrylate functionality is contemplated for use with the present invention. In one embodiment, the acrylate functionality is achieved through at least one acrylate end cap. In another embodiment, the acrylate functionality is achieved by endcapping both ends of the saturated hydrocarbon with acrylates. In addition, the acrylate functionality may be random. As used herein, the term "acrylate" is intended to refer to the following generic structure:

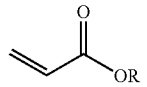

where R may be hydrogen, aliphatic, aromatic carbocyclic, heterocyclic, halogenated perfluoroalkyl, dialkylaminoalkyl, or substituted moieties, each having less than about 20 carbon atoms. In one embodiment, R is an alkyl or cycloalkyl moiety such as methyl, ethyl, propyl, isopropyl, n-butyl, sec-butyl, t-butyl, methylhexyl, ethylhexyl, n-amyl, isoamyl, n-octyl, stearyl, lauryl, or cyclohexyl moiety. For example, R may be a straight or branched $C_{4-8}$ alkyl group, such as isobutyl, n-pentyl, isoamyl, n-hexyl, 2-ethylhexyl, and n-octyl. In another embodiment, R is an alkoxyalkyl group containing about 2 to about 12 carbon atoms, such as methoxyethyl, methoxymethyl, ethoxyethyl, butoxyethyl, and ethoxypropyl. In still another embodiment, R may be a straight chain or branched $C_{1-3}$ alkyl group, such as methyl, ethyl, and propyl.

For example, the acrylate may be an acrylic acid ester or methacrylic acid ester, or a mixture thereof. In particular, the acrylate may be an alkyl ester of acrylic acid (i.e., alkyl acrylate), an alkyl ester of methacrylic acid (i.e., alkyl methacrylate), or a mixture thereof. Non-limiting examples of useful acrylates according to the invention include $C_1$-$C_8$ alkyl esters or glycidyl ester derivatives of unsaturated carboxylic acids such as acrylate, methyl acrylate, methyl methacrylate, ethyl acrylate, ethyl methacrylate, butyl acrylate, butyl methacrylate, glycidyl acrylate, glycidal methacrylate, and mixtures thereof.

In one embodiment, the composition may include a combination of acrylates. In particular, the composition may include a polyacrylate elastomers including (a) a $C_{4-8}$ acrylate where the alkyl group may be straight or branched, (b) a $C_{1-3}$ acrylate where the alkyl group is straight or branched, and/or (c) an acrylate with an alkoxyalkyl group having about 2 to about 12 carbon atoms. For example, the polyacrylate elastomer may include n-butyl acrylate, methyl acrylate, and/or methoxyethyl acrylate.

In this aspect of the invention, the polyacrylate elastomer may include about 5 mole percent or greater of the $C_{4-8}$ acrylate where the alkyl group may be straight or branched, if included, about 30 mole percent or less of the acrylate with an alkoxyalkyl group having about 2 to about 12 carbon atoms, and the balance to a total of 100 mole percent of the $C_{1-3}$ acrylate where the alkyl group is straight or branched. In one embodiment, the $C_{4-8}$ acrylate is included in an amount of at least 10 mole percent. In another embodiment, when included in the polyacrylate elastomer, the acrylate with an alkoxyalkyl group having about 2 to about 12 carbon atoms is included in amount of about 20 mole percent to about 30 mole percent.

For example, the polyacrylate elastomer may include about 45 percent to about 75 percent by weight of the $C_{1-3}$ acrylate and about 25 percent to about 55 percent by weight of the $C_{4-8}$ acrylate based on the total weight of the polyacrylate elastomer. In another embodiment, the polyacrylate elastomer may include about 5 percent to about 30 percent of the $C_{1-3}$ acrylate, about 40 percent to about 70 percent by weight of the $C_{4-8}$ acrylate based on the total weight of the polyacrylate elastomers, and about 20 percent to about 30 percent by weight of the acrylate with an alkoxyalkyl group having about 2 to about 12 carbon atoms.

Cure Systems

When the composition of the invention is based on acrylic elastomers with a saturated backbone, crosslinking is accomplished via the incorporation of the copolymerized reactive cure sites. The nature of this cure site can vary depending on the type of acrylic. For example, as briefly described above, because a dipolymer responds to peroxide cures, the system for vulcanization for a dipolymer according to the invention preferably includes a free radical initiator, such as a peroxide, and a coagent. The peroxide is not specifically limited, however, suitable peroxides for use in the vulcanization process include, but are not limited to, the following:

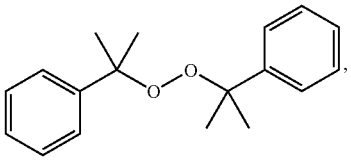

dicumyl peroxide

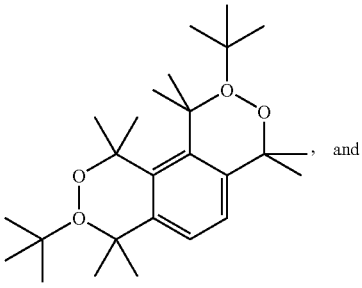

α-α-bis(t-butyl peroxy) diisopropylbenzene mixtures thereof. In addition, di-t-amyl peroxide, 1,1-bis(t-butylperoxy)-3,3,5-trimethylcyclohexane or 1,1-di(t-butylperoxy)3,3,5-trimethyl cyclohexane, di-t-butyl peroxide, 2,5-di-(t-butylperoxy)-2,5-dimethyl hexane, 2,5-dimethyl-2,5-di-benzoylperoxyhexane, n-butyl-4,4-bis(t-butylperoxy) valerate, lauryl peroxide, benzoyl peroxide, t-butyl hydroperoxide, t-butyl cumylperoxide, t-butyl peroxybenzoate, 2,4-dichloro-benzoyl peroxide, and mixtures thereof are contemplated for use in the cure systems.

It is well known that peroxides are available in a variety of forms having different activity. The activity is typically defined by the "active oxygen content." For example, DICUP® 40C, commercially available from GEO Specialty Chemicals of Gibbstown, N.J., is 40 percent active. The peroxide is typically present in an amount greater than about 0.1 parts per hundred of the total rubber-based composition, preferably about 0.1 to 15 parts per hundred of the total rubber-based composition, and more preferably about 0.2 to 5 parts per hundred of the total rubber-based composition. If the peroxide is present in pure form, it is preferably present in an amount of at least about 0.25 phr, more preferably between about 0.35 phr and about 2.5 phr, and most preferably between about 0.5 phr and about 2 phr per hundred of the total rubber-based composition. Peroxides are also available in concentrate form, which are well-known to have differing activities, as described above. In this case, if concentrate peroxides are employed in the present invention, one skilled in the art would know that the concentrations suitable for pure peroxides are easily adjusted for concentrate peroxides by dividing by the activity. For example, 2 phr of a pure peroxide is equivalent 4 phr of a concentrate peroxide that is 50 percent active (i.e., 2 divided by 0.5=4).

In addition to peroxides, other free radical sources suitable for use with the present invention include persulfates, azo compounds, benzophenones, hydrazides, and combinations thereof are contemplated for use as part of the cure system for the dipolymer. In this aspect of the invention, the amount of free radical source is about 5 phr or less, preferably about 3 phr or less, more preferably about 2.5 phr or less, and even more preferably about 2 phr or less per hundred of the total rubber-based composition. In still another embodiment, the amount of free radical source is about 1 phr or less, preferably about 0.75 phr or less per hundred of the total rubber-based composition. In addition, other high energy radiation sources are contemplated for use with the present invention such as ultraviolet curing, electron beam, gamma radiation, plasma, thermal radiation, chemical radiation, and the like.

Examples of the coagent include, but are not limited to, a sulfur-containing compound, a multifunctional monomer, a maleimide compound, a quinone compound, a low molecular weight polybutadiene polymer, and mixtures thereof. In one embodiment, the coagent is a low molecular weight polybutadiene polymer with a number average molecular weight ($M_n$) of about 5000 or less. In another embodiment, the coagent has a $M_n$ of about 4000 or less. In yet another embodiment, the $M_n$ is about 500 to about 2000. For example, Ricon® 152, commercially available from Sartomer Chemicals, Inc., is a low molecular weight ($M_n$=1600), liquid polybutadiene resin with moderately high vinyl functionality for high reactivity, exceptional hydrophobicity and excellent processing characteristics, such as desirable crosslink densities without affecting the rate of cure.

Examples of suitable sulfur-containing compounds include, but are not limited to, sulfur, dipentamethylene thiuram tetrasulfide, mercaptobenzothiazole, 2-mercaptoimixazone, mercaptoimidazole, mercaptoimidazoline, and mixtures thereof. Nonlimiting examples of the multifunctional monomer include divinylbenzene, ethylene glycol dimethacrylate, diallyl phthalate, trimethylolpropane trimethacrylate, triallyl cyanurate, triallyl isocyanurate (TAIC), triallyl trimellitate and triallyl tricyanurate. Examples of the maleimide compound include, but are not limited to, bismaleimides such as N,N'-m-phenylene bismaleimide, toluylene bismaleimides such as toluene-2,4-bismaleimide, and mixtures thereof. Examples of the quinone compound include, but are not limited to, quinone dioxime, dibenzoyl-p-quinone dioxide, and mixtures thereof. In another embodiment, a coagent is zinc diacrylate, zinc dimethacrylate, zinc triacrylate, and the like.

The coagent is preferably present in an amount of about 0.5 parts to about 25 parts per hundred parts of rubber. In one embodiment, the coagent is included in the composition in an amount of about 1 part to about 20 parts per hundred parts of rubber. In another embodiment, the coagent is present in an amount of about 5 parts to about 15 parts per hundred parts of rubber.

With regard to a peroxide cure system, a catalyst may also be employed to lower the initiation temperature if a higher temperature free radical initiator is used. A suitable catalyst may include cobalt, which is commercially available from OMG Industries under the tradename COBALT TEN-CEM®, COBALT HEX-CEM®, and COBALT CEM-ALL. As known to those of ordinary skill in the art, the catalyst concentration is highly dependent on the choice of the peroxide and cure cycle. Thus, a skilled artisan would be able to select the appropriate catalyst concentration once the peroxide and cure cycle are known. In one embodiment, the catalyst is included in the compositions of the invention in an amount of about 0.005 percent to about 1 percent. In another embodiment, the catalyst is present in an amount of about 0.05 weight percent or greater. In another embodiment, the catalyst is present in an amount of about 0.5 weight percent or greater.

Because a terpolymer responds to diamine cures, the system for vulcanization for a terpolymer according to the invention preferably includes at least one diamine, and more preferably a combination of diamine salts and organic accelerators. Without being bound to any particular theory, the use of such a cure system results in permanent crosslinks formed by the reaction with the carboxylic sites on the polymer backbone. In one embodiment, the diamine is a primary amine. In another embodiment, the diamine is a blocked primary amine. The diamine may also be a secondary amine.

Nonlimiting examples of suitable diamines for use in the cure system include the following:

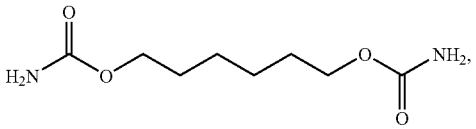

hexamethylene carbamate

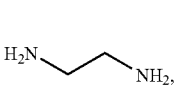

ethylenediamine

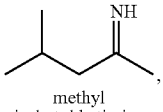

methyl isobutyl ketimine reaction products thereof. For example, EPIKURE™ 3502, commercially available from Hexion Specialty Chemicals, Inc. of Columbus, Ohio, a low viscosity ketimine that is the reaction product of ethylene diamines and methyl isobutyl ketone, is suitable for use as a curing agent for use with the terpolymer according to the invention. Other examples include aliphatic amines such as triethylene triamine, triethylene tetramine, hexamethylene diamine, N,N-dicinnamilidene-1,6-hexanediamine, diethylene triamine, and tetraethylene pentamine; partially-hydrogenated aliphatic polyamines such as partially-hydrogenated 1,3-bis(aminomethyl)cyclohexane, partially-hydrogenated 4,4'-methylenebis cyclohexyl amine, partially-hydrogenated 4,4'-methylenebis cyclohexylamine carbamate and partially-hydrogenated p,p-methylene dianiline; aromatic polyamines such as p,p-methylene dianiline, m-phenylene diamine and methaxylene amine; organic carboxylic ammonium such as polyamide amine, ketimine, silamine, 2,2-bis{4-(4-aminophenoxy)phenyl}propane (BAPP), imidazole, 2-methyl imidazole, 2-ethyl-4-methyl imidazole, 2-phenyl imidazole, 2-undecyl imidazole, 2-heptadecyl imidazole, 1-methyl-2-ethyl imidazole, 1,2-dimethyl imidazole, 1-benzyl-2-ethyl imidazole, 2-phenyl-4-methyl imidazole, 1-cyanoethyl-2-methyl imidazole, 1-cyanoethyl-2-phenyl imidazole, 1-cyanoethyl-2-undecyl imidazole, 1-cyanoethyle-2-methyl-imidazole-trimellitate, 1-benzyl-2-methyl imidazole, ammonium benzoate, and ammonium adipate; derivatives thereof and mixtures thereof.

The diamine component of such a cure system may be included in an amount of about 1 part to about 5 parts per hundred parts of rubber, preferably about 1 part to about 3 parts per hundred parts of rubber.

Examples of accelerators include, but are not limited to the following:

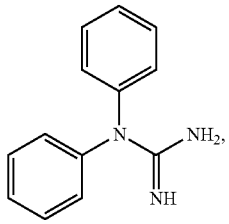

diphenyl guanidine

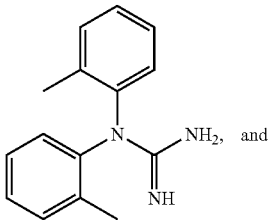

di-orthotolyl guanidine mixtures thereof. In one embodiment, the cure system for the terpolymer includes hexamethylene diamine carbamate and di-orthotolyl guanidine. In another embodiment, the terpolymer cure system includes hexamethylene diamine carbamate and diphenyl guanidine. The accelerator may be included in an amount of about 0.5 part to about 10 parts per hundred parts of rubber, preferably about 1 parts to about 5 parts per hundred parts rubber, and more preferably about 2 parts to about 4 parts per hundred parts rubber.

In addition to the diamines/accelerator cure system for the terpolymer, peroxide systems, such as the ones discussed above with respect to the dipolymer may be used. However, because mold sticking may be an issue with a peroxide cure of the terpolymer, it is preferable that one or more of the release agents discussed below are used with this system.

It is also contemplated that a diamine, an optional accelerator, a peroxide, and a coagent are used to cure the terpolymer of the present invention. Without being bound to any particular theory, it is believed that the inclusion of a peroxide and a coagent in addition to a diamine-based cure system results in improved physical properties, such as hardness, flexural modulus, and elongation while still retaining a fast cure rate. As such, in one embodiment, the cure system includes a diamine, a peroxide, and a coagent. Suitable ranges for these components of the cure system are as follows: about 0.5 part to about 5 parts diamine, preferably about 1 part to about 4 parts, and more preferably about 1 part to about 3 parts per hundred parts of rubber; about 0.5 part to about 10 parts peroxide, preferably about 1 part to about 5 parts per hundred parts of rubber; and about 0.5 to about 5 parts coagent, preferably about 1 part to about 4 parts, and more preferably about 2 parts to about 3 parts per hundred parts of rubber.

For example, the cure system may include about 1 part to about 3 parts hexamethylene carbamate, ethylenediamine, methylisobutylketimine, and mixtures thereof, about 1 part to about 5 parts dicumyl peroxide, α,α-bis(t-butyl peroxy)diisopropylbenzene, and mixtures thereof, and about 1 part to about 3 parts coagent, such as low molecular weight polybutadiene, based on a hundred parts of rubber. In this aspect, any of the above-mentioned accelerators may also be included in the cure system.

Additives

The compositions of the invention may include various additives to improve processability, compression set, flex resistance, aging performance, and other important manufacturing and performance characteristics. For example, an antioxidant or antidegradant may be added to the compositions of the invention to prevent degradation of the material. Any antioxidant that prevents deterioration is suitable. In particular, amino and phenolic compounds are contemplated for use with the composition of the invention to act as inhibitors for the radical chain reactions of autoxidation.

Nonlimiting amino compounds for use as the antioxidant include benzenamine, diphenylamine (such as 4,4'-bis(α,α-dimethylbenzyl)diphenylamine), phenothiazine, ethoxyquin, and mixtures thereof. Naugard® 445, commercially available from Crompton of Middlebury, Conn. is an example of a suitable amino compound for use as the antioxidant in accordance with the present invention. In addition, without being bound to any particular theory, because it is believed that zinc compounds catalyze heat aging in the compositions of the invention, a combination of an amino-based antioxidant and hydrazine is preferred to combat such a zinc-catalyzed attack.

Phenol-based antioxidants contemplated for use as antioxidants including, but are not limited to, methylenebisphenols, thiobisphenols (bis(4-oxyphenyl)sulfide), oxybisphenols, iminobisphenols, and mixtures thereof. In particular, nonlimiting examples of such phenolic compounds include 2,2'-methylenebisphenol, 4,4'-methylenebisphenol, 4,4'-methylenebis(2-methylphenol), 2,2'-thiobisphenol, 4,4'-thiobisphenol, 4,4'-thiobis(2-methylphenol), 2,2'-oxybisphenol, 4,4'-oxybisphenol, 2,T-iminobisphenol, 4,4'-iminobisphenol, 4,4'-iminobis(2-methylphenol), and mixtures thereof.

The antioxidant is included in the composition in an amount of about 0.1 to about 5 parts per hundred parts of rubber. In one embodiment, the antioxidant is included in an amount of about 0.5 to about 3 parts per hundred parts of rubber. In another embodiment, the antioxidant is included in an amount of about 2 parts or less per hundred parts of rubber. The amount of antioxidant may also be varied depending on the type of polyacrylate rubber-based composition formed according to the invention. For example, without being bound by any particular theory, less amino-based antioxidant is typically used with the dipolymer than the terpolymer because of the possibility of interference with the peroxide cure. In this regard, about 0.5 to about 3 parts, preferably about 0.5 to about 2 parts, antioxidant may be used with the terpolymer whereas about 0.5 to about 2 parts, preferably about 0.5 to about 1 part antioxidant may be used with the dipolymer. As known to those of ordinary skill in the art, if more antioxidant is necessary in the dipolymer to combat degradation, the level of peroxide should be increased accordingly.

Various fillers may also be used with the compositions of the invention. For example, fillers may be added to the compositions of the invention to affect rheological and mixing properties, the specific gravity (i.e., density-modifying fillers), the modulus, the tear strength, reinforcement, and the like. The fillers are generally inorganic, and suitable fillers include numerous oxides and salts, such as magnesium oxide, tin oxide, titanium dioxide, chromium oxide, iron oxide, and antimony oxide, as well as barium sulfate, magnesium sulfate, calcium carbonate, aluminum hydroxide, magnesium hydroxide, arium carbonate, clay, tungsten, tungsten carbide, low levels of silicas, fumed colloidal silica, regrind (recycled core material typically ground to about 30 mesh particle), coated talc, blanc fixe, high-Mooney-viscosity rubber regrind, carbon black and mixtures thereof. Those of ordinary skill in the art, however, should be aware that fillers such as aluminum hydroxide may affect degradation of the rubber composition and, in particular, heat aging performance, at least in the terpolymer. In addition, if used as a filler, magnesium hydroxide and other active metal oxides are preferably used only in the dipolymer.

In one embodiment, carbon black is included in the composition of the invention. Commercially available examples of suitable carbon black fillers include N762, N774, N550, N683, and Spheron 5000.

In another embodiment, titanium oxide, magnesium oxide, chromium oxide, antimony oxide, iron oxide, or a combination thereof is included in the composition of the invention. In this aspect of the invention, such fillers are present in an amount of about 8 parts or less per hundred parts of rubber. For example, the filler may be included in an amount of about 5 parts or less per hundred parts of rubber. The filler may also be included in an amount of about 3 parts or less per hundred parts of rubber.

Processing aids are also useful in the compositions of the invention. In particular, processing aids such as stearic acid, oleic acid, low molecular weight polyethylene, octadecylamine, alkyl phosphate, and mixtures thereof. For example, a mixture of oleic acid and low molecular weight polyethylene may be used where about 0.25 to about 4 parts oleic acid to about one part of the low molecular weight polyethylene are used.

In one embodiment, a mixture of stearic acid, octadecylamine, and alkyl phosphate are used in the terpolymer. However, it is preferred that alkyl phosphate be excluded or kept to a minimum in the dipolymer due to possible effects on the physical properties. In this regard, the stearic acid is preferably present in an amount of about 0.1 to about 5, more preferably about 0.5 to about 2 parts per hundred parts of rubber. The octadecylamine may be present in an amount of about 0.1 to about 3 parts per hundred parts of rubber, preferably about 0.1 to about 1 parts per hundred parts of rubber, and more preferably about 0.3 to about 0.7 parts per hundred parts of rubber. The alkyl phosphate, if present, may be included in an amount of about 0.5 to about 2 parts per hundred parts of rubber, preferably about 0.75 to about 1.25 parts per hundred parts of rubber. For example, a suitable processing aid for use with the terpolymer may include about 1.5 to about 2 parts stearic acid, about 0.5 parts octadecylamine, and about 1 part alkyl phosphate per hundred parts rubber. In addition, a suitable processing aid for use with the dipolymer may include about 1.5 to about 2 parts stearic acid and about 0.5 parts octadecylamine.

Plasticizers may also be included in the compositions of the invention. It is preferable that the plasticizer be nonvolatile and stable at the highest expected processing temperature to avoid any effects on aging performance. Monomeric and polymeric polyesters are suitable for use with the present invention. For example, for low temperature flexibility, a standard monomeric ester plasticizer may be used, such as DOS or linear copolymers with numerous pendant ester moieties formed from methyl methacrylate and decyl methacrylate. In addition, polyether ester type plasticizers are suitable for use with the present invention, such as adipic acid bis (diethylene glycol monobutyl ether) ester. One commercially available example of such a polyether ester type plasticizer is ADK Cizer RS 35, available from Adeka Palmarole. In this regard, the plasticizer is preferably chosen to provide a temperature range of about −40° C. to about 170° C., preferably −50° C. to about 180° C., and more preferably −60° C. to about 170°.

Additional materials may also be added to the compositions of the invention including, but not limited to, coloring agents or dyes, optical brighteners, crosslinking agents, whitening agents such as $TiO_2$, defoaming agents, softening agents, surfactants, impact modifiers, reinforcing materials, compatibilizers, coupling agents, nanoparticles, such as nano zinc oxide, and nano silica, nanometals such as nano tungsten and nano titanium dioxide, and other conventional additives. The additional materials may be thermoplastic or thermoset in nature. Those of ordinary skill in the art are aware of the purpose of these additives and the amounts that should be employed to fulfill those purposes.

Methods of Forming and Composition Properties

With regard to the dipolymer, the components may be mixed in conventional rubber processing equipment, such as a Banbury mixer (one pass or two pass) or 2-roll mixer, at a temperature below the half-life period temperature of the cure system. Because of the slow rate of cure at low temperatures, significant mixing and dispersion may be accomplished prior to crosslinking. After mixing, the rubber compound may be molded, e.g., compression molded, injection molded, or the like, at temperatures sufficient to crosslink the rubber. For example, the molding temperature may range from about 250° F. to about 400° F., preferably about 280° F. to about 360° F., and more preferably about 300° F. to about 340° F. In addition, melt blending may be employed. Such mixing and subsequent crosslinking may be performed in batch mode or continuous mode.

Similarly, the terpolymer components may be mixed using conventional rubber processing equipment at a temperature below the crosslinking temperature. For example, because cure temperatures can range from about 150° C. to about 200° C., depending on the molding method, the rubber terpolymer may be mixed at a barrel temperature of about 50° C. to about 80° C. and molded at temperatures of about 180° C. and above. The curing mechanism is shown generally below:

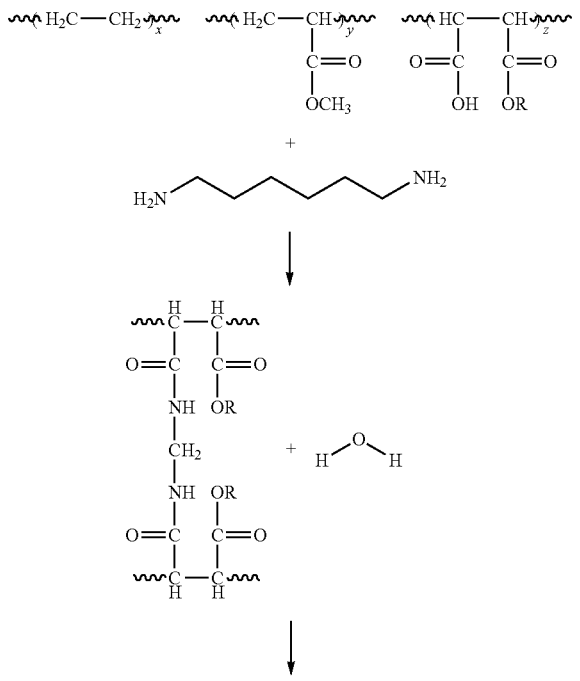

-continued

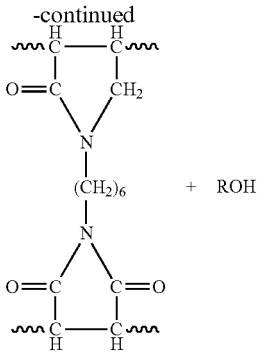

Post-curing of the terpolymer rubber may also be employed. For example, oven cures may follow relatively short molding cycles. In particular, a molding cycle of about 1 to 2 minutes at about 180° C. and above may be followed by an oven cure for an extended period of time, e.g., about 1 hours to about 10 hours, preferably about 2 hours to about 8 hours, and more preferably about 3 hours to about 5 hours, at a temperature of about 160° C. to about 200° C., preferably about 170° C. to about 190° C.

While not necessary, shorter post-cure cycles for the dipolymer are also contemplated. For example, an oven post-cure of about one hour or less, about 30 minutes or less, or about 15 minutes to about 30 minutes at temperatures of about 160° C. to about 200° C., preferably about 170° C. to about 190° C. may be beneficial to the dipolymer depending on the exact cure system.

Those of ordinary skill in the art would recognize that, in addition to the examples discussed above and below, other suitable methods exist for forming the polyacrylate rubbers of the present invention. For example, the compositions of the invention may be injection molded or cast.

The resulting material hardness of the polyacrylate rubber composition is between about 40 Shore A to about 90 Shore A (ASTM D-2240). In one embodiment, the hardness is about 50 Shore A to about 80 Shore A. In another embodiment, the hardness is about 55 Shore A to about 75 Shore A. In still another embodiment, the hardness is about 55 Shore A to about 65 Shore A. Those of ordinary skill in the art would readily understand that modifying the coagent will affect hardness. For example, increasing the amount of coagent will likely increase the material hardness of the composition. In addition, the use of a benzene or the like attached to the cure site will also allow alteration of the material hardness.

In another embodiment, the hardness of the composition of the invention ranges from about 30 Shore D to about 70 Shore D, preferably about 40 Shore D to about 60 Shore D, and more preferably about 45 Shore D to about 55 Shore D.

Composition Blends

The compositions of the invention preferably include from about 1 percent to about 100 percent polyacrylate rubber, however, the compositions may be blended with other types of rubber. For example, in one embodiment, the composition contains about 10 percent to about 90 percent of the polyacrylate rubber of the invention, preferably from about 10 percent to about 75 percent, and contains about 90 percent to 10 percent, more preferably from about 90 percent to about 25 percent of at least one other rubber as described below. Unless otherwise stated herein, all percentages are given in percent by weight of the total composition of the golf ball layer in question.

Suitable rubbers for use in the polyacrylate rubber-based composition of the invention include, but are not limited to, partially or completely hydrogenated nitrile rubber, ethylene propylene rubber, natural rubber, polynorbornene rubber, polychloroprene rubber, polysulfide rubber, polyurethane rubber, butyl and chlorobutyl rubber, fluoroelastomers and perfluoroelastomers, silicone and fluorosilicone rubber, tetrafluoroethylene/propylene rubber, neoprene, epichlorohydrin, hypalon, diene rubbers such as butadiene rubber and styrene butadiene rubber, chlorinated polyethylene rubber, chlorosulfonated polyethylene rubber, isoprene rubber, and combinations thereof.

Golf Ball Construction

The polyacrylate rubber composition of the present invention may be used with any type of ball construction. For example, one-piece, two-piece, three-piece, and four-piece golf ball designs are contemplated by the present invention. In addition, golf balls having double cores, intermediate layer(s), and/or double covers are also useful with the present invention. As known to those of ordinary skill in the art, the type of golf ball constructed, i.e., double core, double cover, and the like, depends on the type of performance desired of the ball. As used herein, the term "layer" includes any generally spherical portion of a golf ball, i.e., a golf ball core or center, an intermediate layer, and/or a golf ball cover. As used herein, the term "inner layer" refers to any golf ball layer beneath the outermost structural layer of the golf ball. As used herein, the term "multilayer" means at least two layers.

The compositions of the invention are intended for use in forming structural layers having a thickness of about 50 μm or greater. As used herein, "structural layer" does not include a decorative coating layer, top coat, paint layer, or the like.

Figure 2:
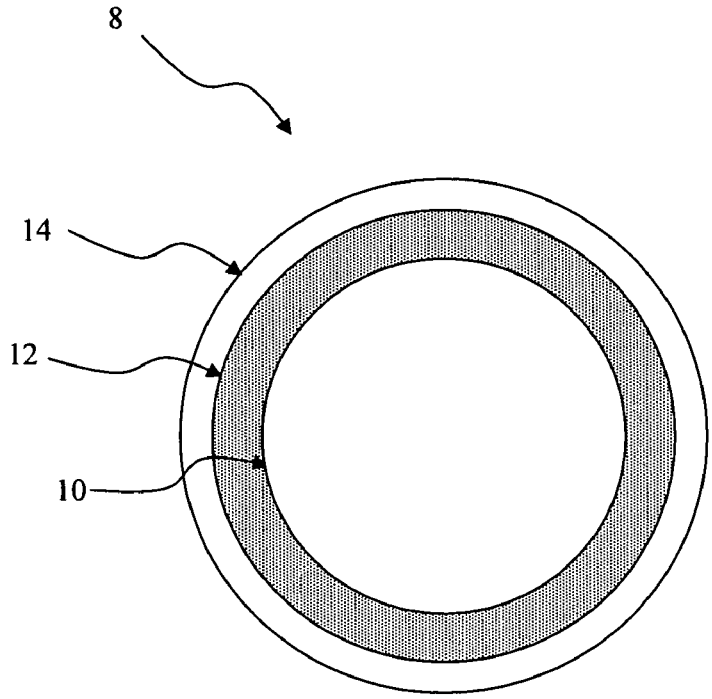
FIG. 2 is a cross-sectional view of a multi-component golf ball, wherein at least a portion of the golf ball is formed from the compositions of the invention.
Figure 3:
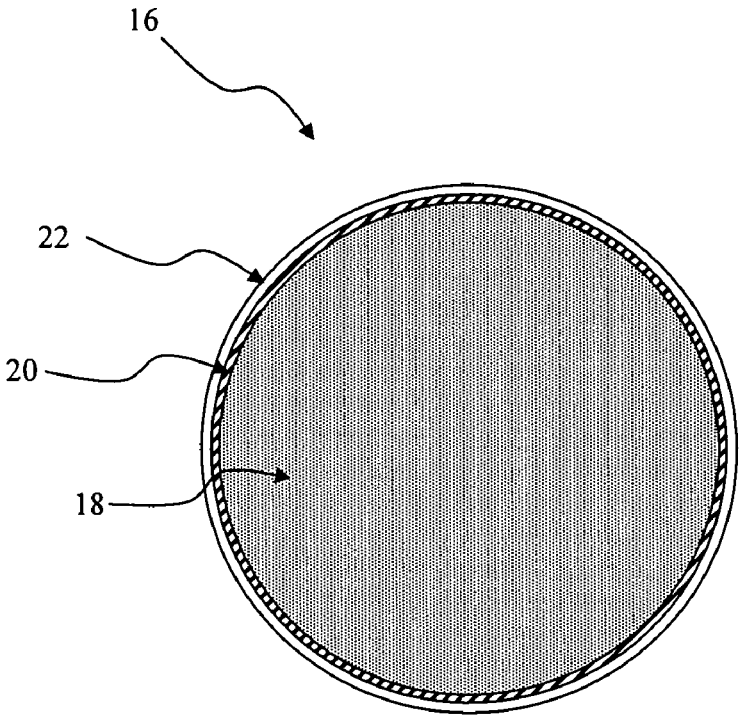
FIG. 3 is a cross-sectional view of a multi-component golf ball including a large core, an intermediate layer, and a thin outer cover layer disposed thereon, wherein at least a portion of the golf ball is formed from the compositions of the invention.
Figure 4:
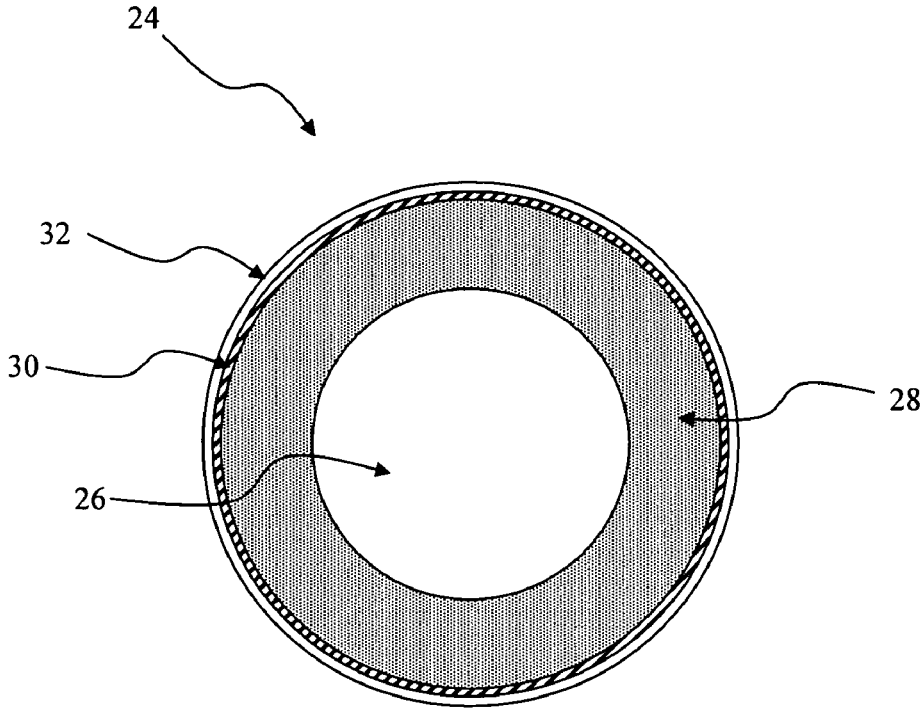
FIG. 4 is a cross-sectional view of a multi-component golf ball including a core, an outer core layer, a thin inner cover layer, and a thin outer cover layer disposed thereon, wherein at least a portion of the golf ball is formed from the compositions of the invention.

In one embodiment, a golf ball 2 according to the invention (as shown in FIG. 1) includes a core 4 and a cover 6, wherein the at least one of core 4 and cover 6 incorporates at least one layer including the composition of the invention. Similarly, FIG. 2 illustrates a golf ball according to the invention incorporating an intermediate layer. Golf ball 8 includes a core 10, a cover 14, and an intermediate layer 12 disposed between the core 10 and cover 14. Any of the core 10, intermediate layer 12, or cover 14 may incorporate at least one layer that includes the composition of the invention. FIG. 3 illustrates a multilayer golf ball 16 according to the invention including a large core 18, an outer core layer, intermediate layer, or inner cover layer 20, and an outer cover layer 22. Any of the core 18, outer core layer, intermediate layer, or inner cover layer 20, and outer cover layer 22 may include the acrylate functional composition of the invention. FIG. 4 shows a four-piece golf ball 24 according to the invention including a core 26, an outer core layer or intermediate layer 28, an inner cover layer 30, and an outer cover layer 32. Any of the core 26, outer core layer or intermediate layer 28, inner cover layer 30, and outer cover layer 32 may include the acrylate functional composition of the invention.

Other non-limiting examples of suitable types of ball constructions that may be used with the present invention include those described in U.S. Pat. Nos. 6,056,842, 5,688,191, 5,713,801, 5,803,831, 5,885,172, 5,919,100, 5,965,669, 5,981,654, 5,981,658, and 6,149,535, as well as in Publication Nos. US2001/0009310 A1, US2002/0025862, US2002/0028885, US2002/0151380. The entire disclosures of these patents and published patent applications are incorporated by reference herein. For example, in Publication No. US2002/015380, a golf ball having three or more cover layers is disclosed, of which any of the layers of the ball may be formed using the polyacrylate rubber compositions of the invention. In addition, the compositions of the invention are contemplated for use in layers of the gradated hardness multilayer golf balls disclosed in U.S. Patent Publication No. 2001/0005699, which is incorporated by reference herein in its entirety.

As discussed, the golf balls of the invention include at least one structural layer that includes the polyacrylate rubber compositions of the invention. In addition, as discussed in more detail below, the golf balls of the invention may include core layers, intermediate layers, or cover layers formed from materials known to those of skill in the art. These examples are not exhaustive, as skilled artisans would be aware that a variety of materials might be used to produce a golf ball of the invention with desired performance properties.

Core Layer(s)

The cores of the golf balls formed according to the invention may be solid, semi-solid, hollow, fluid-filled, or powder filled, but are preferably solid and formed with the compositions of the invention. As used herein, the term "core" means the innermost portion of a golf ball, and may include one or more layers. For example, U.S. Pat. Nos. 6,180,040 and 6,180,722 disclose methods of preparing dual core golf balls. The entire disclosures of these patents are incorporated by reference herein. The term "semi-solid" as used herein refers to a paste, a gel, or the like. The cores of the golf balls of the invention may be spherical, cubical, pyramid-shaped, geodesic, or any three-dimensional, symmetrical shape.

The polyacrylate rubber compositions of the invention may be used to form cores. I addition, the polyacrylate rubber compositions may be blended with other conventional core materials to form a core or, in the alternative, a core may be formed of conventional core materials and another layer of the golf ball may include the polyacrylate rubber compositions of the invention. In this regard, suitable core materials include, but are not limited to, thermoset materials, such as rubber, styrene butadiene, polybutadiene, isoprene, polyisoprene, trans-isoprene, and polyurethane, and thermoplastic materials, such as conventional ionomer resins, polyamides, polyesters, and polyurethane. In one embodiment, at least one layer of the core is formed from a polybutadiene reaction product, such as the reaction products disclosed in U.S. Patent Publication No. 2003/0119989, the entire disclosure of which is incorporated by reference herein.

Whether the polyacrylate rubber compositions of the invention (alone or in combination with conventional core materials) or conventional core materials alone (without the polyacrylate rubber compositions of the invention) are used to form the core, any of the additives discussed above and other conventional additives, such as catalysts, coloring agents, optical brighteners, crosslinking agents, whitening agents, UV absorbers, hindered amine light stabilizers, defoaming agents, processing aids, and surfactants, may be added to the core layer compositions of the invention. In addition, antioxidants, stabilizers, softening agents, plasticizers, including internal and external plasticizers, impact modifiers, foaming agents, density-adjusting fillers, reinforcing materials, and compatibilizers may also be added to any of the core layer compositions. One of ordinary skill in the art should be aware of the requisite amount for each type of additive to realize the benefits of that particular additive.

The core may have a hardness gradient from the center to the surface. For example, the core may have a first hardness at an interior location and a second hardness at an exterior surface location as measured on a molded sphere. In one embodiment, the first amount is at least about 6 percent less than the second amount, preferably at least about 10 percent less than the second amount, and more preferably at least about 20 percent less than the second amount. In another embodiment, the center has a first point, typically near the geometric center of the golf ball center, with a first hardness, and a second point, typically near the surface of the golf ball center, with a second hardness, wherein the second hardness is at least about 10 percent greater than the first hardness. In other embodiment, the second hardness is at least about 20 percent greater, or at least about 30 percent greater, than the first hardness.

In addition, zero gradient cores, i.e., cores with an insignificant difference in hardness from center to surface, or reverse gradient cores, i.e., cores having a surface hardness less than the center hardness, are contemplated. As such, in one embodiment, the first and second hardness differ only by about 2 percent or less, preferably about 1 percent or less, and more preferably about 0.5 percent or less. In another embodiment, there is no difference between the first and second hardnesses. As will be appreciated by those of ordinary skill in the art, a zero gradient core may be accomplished by adjusting the molding parameters. For example, a zero gradient core may be achieved with a more uniform cure, which can be accomplished by adjusting the cycle time or molding temperature. In particular, a longer cycle time and/or a lower molding temperature is contemplated to provide a more uniform cure.

In an alternate embodiment, a reverse gradient core includes cores with a first hardness (at the center of the core) that is greater than the second hardness (at the surface of the core). In particular, the first hardness may be at least about 6 percent more than the second amount, preferably at least about 10 percent more than the second amount, and more preferably at least about 20 percent more than the second amount. In another embodiment, the center has a first point, typically near the geometric center of the golf ball center, with a first hardness, and a second point, typically near the surface of the golf ball center, with a second hardness, wherein the first hardness is at least about 10 percent greater than the second hardness. In other embodiment, the second hardness is at least about 20 percent less, or at least about 30 percent less, than the first hardness. Those of ordinary skill in the art will appreciate that, based on the insulating nature of rubbers and plastics, such a reverse gradient may be accomplished by quenching the reaction during molding to allow the outside of the core to cool faster than the inside of the core.

The core may also include one or more wound layers (surrounding a fluid or solid center) including at least one tensioned elastomeric material wound about the center. In one embodiment, the tensioned elastomeric material includes natural or synthetic elastomers or blends thereof, in which the synthetic elastomer preferably includes LYCRA. In another embodiment, the tensioned elastomeric material incorporates a polybutadiene reaction product as disclosed in co-pending U.S. Patent Publication No. 2003/0119989. In yet another embodiment, the tensioned elastomeric material may also be formed from conventional polyisoprene. In still another embodiment, a polyurea composition (as disclosed in co-pending U.S. Patent Publication No. 2003/0096936, which is incorporated by reference in its entirety by reference herein) is used to form the tensioned elastomeric material. In another embodiment, solvent spun polyethers urea, as disclosed in U.S. Pat. No. 6,149,535, which is incorporated in its entirety by reference herein, is used to form the tensioned elastomeric material in an effort to achieve a smaller cross-sectional area with multiple strands.

The tensioned elastomeric layer may also be a high tensile filament having a tensile modulus of about 10,000 kpsi or greater, as disclosed in co-pending U.S. Patent Publication Nos. 2002/0160859 and 2002/0160862, the entire disclosures of which are incorporated by reference herein.

In another aspect of the invention, the golf balls of the invention include a thin, highly filled core layer, such as the ones disclosed in U.S. Pat. No. 6,494,795, which is incorporated by reference herein in its entirety. A thin, highly filled core layer allows the weight or mass of the golf ball to be allocated radially relative to the centroid, thereby dictating the moment of inertia of the ball. When the weight is allocated radially toward the centroid, the moment of inertia is decreased, and when the weight is allocated outward away from the centroid, the moment of inertia is increased.

Intermediate Layer(s)

As used herein, "intermediate layer" includes any layer between the innermost layer of the golf ball and the outermost layer of the golf ball. Therefore, intermediate layers may also be referred to as outer core layers, inner cover layers, and the like. When the golf ball of the present invention includes an intermediate layer, this layer may be formed from the polyacrylate rubber compositions of the invention.

The intermediate layer may also be formed of conventional materials known to those of ordinary skill in the art, including various thermoset and thermoplastic materials, as well as blends thereof. For example, the intermediate layers of the golf ball of the invention may be formed with the compositions of the invention. The intermediate layer may likewise be formed, at least in part, from one or more homopolymeric or copolymeric materials, such as vinyl resins, polyolefins, polyurethanes, polyureas, polyamides, acrylic resins, olefinic thermoplastic rubbers, block copolymers of styrene and butadiene, isoprene or ethylene-butylene rubber, copoly(ether-amide), polyphenylene oxide resins, thermoplastic polyesters, ethylene, propylene, 1-butene or 1-hexene based homopolymers or copolymers, and the like.

The intermediate layer may also be formed from highly neutralized polymers such as those disclosed U.S. Patent Publication No. 2001/0018375 and 2001/0019971, which are incorporated herein in their entirety by express reference thereto; grafted and non-grafted metallocene catalyzed polyolefins and polyamides, polyamide/ionomer blends, and polyamide/nonionomer blends, such as those disclosed in U.S. Patent Publication No. 2003/0078348, which is incorporated by reference herein in its entirety; among other polymers. Examples of other suitable intermediate layer materials include blends of some of the above materials, such as those disclosed in U.S. Pat. No. 5,688,181, the entire disclosure of which is incorporated by reference herein.

Additional materials may be included in the intermediate layer compositions outlined above. For example, catalysts, coloring agents, optical brighteners, crosslinking agents, whitening agents such as TiO2 and ZnO, UV absorbers, hindered amine light stabilizers, defoaming agents, processing aids, surfactants, and other conventional additives may be added to the intermediate layer compositions of the invention. In addition, antioxidants, stabilizers, softening agents, plasticizers, including internal and external plasticizers, impact modifiers, foaming agents, density-adjusting fillers, reinforcing materials, and compatibilizers may also be added to any of the intermediate layer compositions. One of ordinary skill in the art should be aware of the requisite amount for each type of additive to realize the benefits of that particular additive.

The intermediate layer may also be formed of a binding material and an interstitial material distributed in the binding material, as discussed in U.S. Patent Publication No. 2003/

0125134, the entire disclosure of which is incorporated by reference herein. In addition, at least one intermediate layer may also be a moisture barrier layer, such as the ones described in U.S. Pat. No. 5,820,488, which is incorporated in its entirety by reference herein. The intermediate layer may also be formed from any of the polyurethane, polyurea, and polybutadiene materials discussed co-pending U.S. Patent Publication No. 2003/0096936.

Cover Layer(s)

The cover provides the interface between the ball and a club. As used herein, the term "cover" means the outermost portion of a golf ball. A cover typically includes at least one layer and may contain indentations such as dimples and/or ridges. Paints and/or laminates are typically disposed about the cover to protect the golf ball during use thereof. The cover may include a plurality of layers, e.g., an inner cover layer disposed about a golf ball center and an outer cover layer formed thereon.

Inner and/or outer cover layers may be formed from the polyacrylate rubber compositions of the invention. Alternatively, both the inner and/or outer cover layers of golf balls of the present invention may be formed of highly neutralized ionomer compositions, polyurethane, polyurea, or other cover materials known to those of skill in the art. For example, the cover may be formed of polyurea, polyurethane, or mixtures thereof, as disclosed in co-pending U.S. Patent Publication No. 2003/0096936 and U.S. Pat. No. 7,041,769. The entire disclosures of these applications are incorporated by reference herein.

In addition, cover layers may also be formed of one or more homopolymeric or copolymeric materials, such as vinyl resins, polyolefins, conventional polyurethanes and polyureas, such as the ones disclosed in U.S. Pat. Nos. 5,334,673, and 5,484,870, polyamides, saturated acrylic resins and blends of these resins with poly vinyl chloride, elastomers, and the like, thermoplastic urethanes, olefinic thermplastic rubbers, block copolymers of styrene and butadiene, polyphenylene oxide resins or blends of polyphenylene oxide with high impact polystyrene, thermoplastic polyesters, ethylene, propylene, 1-butene or 1-hexane based homopolymers or copolymers including functional monomers, methyl acrylate, methyl methacrylate homopolymers and copolymers, low acid ionomers, high acid ionomers, alloys, and mixtures thereof. Those of ordinary skill in the art would recognize that the saturated acrylic resins mentioned above are distinct from the unsaturated acrylic resins used to endcap the precursors of the present invention. For example, the saturated acrylic resins disclosed in the prior art are typically acrylic and methacrylic resins used in ionomer resin compositions. Such acrylic resins are thermoplastic, unreactable materials. In contrast, the unsaturated acrylic resins for use with the present invention are castable and reactive in nature.

The cover may also be at least partially formed from a polybutadiene reaction product as disclosed in U.S. Patent Publication No. 2003/0119989.

Additional materials may be included in the cover layer compositions outlined above. For example, catalysts, coloring agents, optical brighteners, crosslinking agents, whitening agents such as $TiO_2$ and ZnO, UV absorbers, hindered amine light stabilizers, defoaming agents, processing aids, surfactants, and other conventional additives may be added to the cover layer compositions of the invention. In addition, antioxidants, stabilizers, softening agents, plasticizers, including internal and external plasticizers, impact modifiers, foaming agents, density-adjusting fillers, reinforcing materials, and compatibilizers may also be added to any of the cover layer compositions. Those of ordinary skill in the art should be aware of the requisite amount for each type of additive to realize the benefits of that particular additive.

In addition, while hardness gradients are typically used in a golf ball to achieve certain characteristics, the present invention also contemplates the compositions of the invention being used in a golf ball with multiple cover layers having essentially the same hardness, wherein at least one of the layers has been modified in some way to alter a property that affects the performance of the ball. Such ball constructions are disclosed in U.S. Patent Publication No. 2003/0232666, the entire disclosure of which is incorporated by reference herein.

As discussed above with respect to the core of the golf balls of the invention, the use of a thin, highly filled layer allows the weight or mass of the golf ball to be allocated radially relative to the centroid, thereby dictating the moment of inertia of the ball. This concept is translatable to the cover layers of a golf ball. Thus, the inner cover layer may be a thin, dense layer so as to form a high moment of inertia ball. In this aspect of the invention, the inner cover layer preferably has a specific gravity of greater than 1.2, more preferably more than 1.5, even more preferably more than 1.8, and most preferably more than 2.0. Suitable materials for the thin, dense layer include any material that meets the specific gravity stated above. For example, this thin, highly filled inner cover layer may be formed of the radiation-curable compositions of the invention, adjusting for the requisite specific gravity. Alternatively, the inner cover layer may be formed from epoxies, styrenated polyesters, polyurethanes or polyureas, liquid PBR's, silicones, silicate gels, agar gels, and the like.

Methods for Forming Golf Ball Components

The golf balls of the invention may be formed using a variety of application techniques such as compression molding, flip molding, injection molding, retractable pin injection molding, reaction injection molding (RIM), liquid injection molding (LIM), casting, vacuum forming, powder coating, flow coating, spin coating, dipping, spraying, and the like depending on the materials used for a specific component. For example, the polyacrylate rubber compositions of the invention are particular useful in molding applications. Thus, golf ball components including the compositions of the invention may be formed by compression molding and injection molding.

A method of injection molding using a split vent pin can be found in co-pending U.S. Patent Publication No. 2002/0079615. Examples of retractable pin injection molding may be found in U.S. Pat. Nos. 6,129,881, 6,235,230, and 6,379,138. These molding references are incorporated in their entirety by reference herein.

One skilled in the art would appreciate that the molding method used may be determined at least partially by the properties of the composition. For example, compression molding or injection molding may be preferred for liquid compositions (such as gumstock) or thermoplastic precursors, whereas casting, RIM, or LIM may be preferred when the material is thermoset. In addition, the intermediate layer may also be formed from using any suitable method known to those of ordinary skill in the art. For instance, an intermediate layer may be formed by casting and covered with a dimpled cover layer formed by injection molding, compression molding, casting, vacuum forming, powder coating, and the like.

Any inner layer of a golf ball formed according to the invention may be surface treated prior to cover formation to further increase the adhesion between the outer surface of the inner ball and the cover. In addition, the outermost cover of the golf balls of the invention may be surface treated prior to application of any coating layer. Such surface treatment may include mechanically or chemically abrading the outer surface of the subassembly. Additionally, the inner ball may be subjected to corona discharge, plasma treatment, and/or silane dipping prior to forming the cover around it. Other layers of the ball, e.g., the core, also may be surface treated. Examples of these and other surface treatment techniques can be found in U.S. Pat. No. 6,315,915, which is incorporated by reference in its entirety.

The methods discussed herein and other manufacturing methods for forming the golf ball components of the present invention are also disclosed in U.S. Pat. Nos. 6,207,784 and 5,484,870, the disclosures of which are incorporated herein by reference in their entirety.

Dimples

The golf balls of the invention are preferably designed with certain flight characteristics in mind. The use of various dimple patterns and profiles provides a relatively effective way to modify the aerodynamic characteristics of a golf ball. As such, the manner in which the dimples are arranged on the surface of the ball can be by any available method. For instance, the ball may have an icosahedron-based pattern, such as described in U.S. Pat. No. 4,560,168, or an octahedral-based dimple patterns as described in U.S. Pat. No. 4,960,281. Alternatively, the dimple pattern can be arranged according to phyllotactic patterns, such as described in U.S. Pat. No. 6,338,684, or a tubular lattice pattern, such as the one disclosed in U.S. Pat. No. 6,290,615, the disclosures of which are incorporated herein in their entirety.

Dimple patterns may also be based on Archimedean patterns including a truncated octahedron, a great rhombcuboctahedron, a truncated dodecahedron, and a great rhombicosidodecahedron, wherein the pattern has a non-linear parting line, as disclosed in U.S. Pat. No. 6,705,959, which is incorporated in its entirety by reference herein. The golf balls of the present invention may also be covered with non-circular shaped dimples, i.e., amorphous shaped dimples, as disclosed in U.S. Pat. No. 6,409,615, which is incorporated in its entirety by reference herein.

Dimple patterns that provide a high percentage of surface coverage are preferred, and are well known in the art. For example, U.S. Pat. Nos. 5,562,552, 5,575,477, 5,957,787, 5,249,804, and 4,925,193 disclose geometric patterns for positioning dimples on a golf ball. In addition, dimple patterns for which there is no great circle that does not intersect any dimples are contemplated for use with the present invention, such as the dimple patterns disclosed in U.S. Pat. No. 7,033,286.

In one embodiment, the golf balls of the invention have a dimple coverage of the surface area of the cover of at least about 60 percent, preferably at least about 65 percent, and more preferably at least 70 percent or greater. Dimple patterns having even higher dimple coverage values may also be used with the present invention. Thus, the golf balls of the present invention may have a dimple coverage of at least about 75 percent or greater, about 80 percent or greater, or even about 85 percent or greater.

The golf balls of the present invention may also have a plurality of pyramidal projections disposed on the intermediate layer of the ball, as disclosed in U.S. Pat. No. 6,383,092, which is incorporated in its entirety by reference herein. The plurality of pyramidal projections on the golf ball may cover between about 20 percent to about 80 of the surface of the intermediate layer. In an alternative embodiment, the golf ball may have a non-planar parting line allowing for some of the plurality of pyramidal projections to be disposed about the equator.

Several additional non-limiting examples of dimple patterns with varying sizes of dimples are also provided in U.S. Pat. Nos. 6,358,161 and 6,213,898, the entire disclosures of which are incorporated by reference herein.

The total number of dimples on the ball, or dimple count, may vary depending such factors as the sizes of the dimples and the pattern selected. In general, the total number of dimples on the ball preferably is between about 100 to about 1000 dimples, although one skilled in the art would recognize that differing dimple counts within this range can significantly alter the flight performance of the ball. In one embodiment, the dimple count is about 380 dimples or greater, but more preferably is about 400 dimples or greater, and even more preferably is about 420 dimples or greater. In one embodiment, the dimple count on the ball is about 422 dimples. In some cases, it may be desirable to have fewer dimples on the ball. Thus, one embodiment of the present invention has a dimple count of about 380 dimples or less, and more preferably is about 350 dimples or less.

Dimple profiles revolving a catenary curve about its symmetrical axis may increase aerodynamic efficiency, provide a convenient way to alter the dimples to adjust ball performance without changing the dimple pattern, and result in uniformly increased flight distance for golfers of all swing speeds. Thus, catenary curve dimple profiles, as disclosed in U.S. Patent Publication No. 2003/0114255, which is incorporated in its entirety by reference herein, is contemplated for use with the golf balls of the present invention.

Golf Ball Post-Processing

The golf balls of the present invention may be painted, coated, or surface treated for further benefits. For example, a golf ball of the invention may be treated with a base resin paint composition or the cover composition may contain certain additives to achieve a desired color characteristic. In one embodiment, the golf ball cover composition contains a fluorescent whitening agent, e.g., a derivative of 7-triazinylamino-3-phenylcoumarin, to provide improved brightness. An example of such a fluorescent whitening agent is disclosed in U.S. Patent Publication No. 2002/0082358, which is incorporated by reference herein in its entirety.

Protective and decorative coating materials, as well as methods of applying such materials to the surface of a golf ball cover are well known in the golf ball art. Generally, such coating materials comprise urethanes, urethane hybrids, epoxies, polyesters and acrylics. If desired, more than one coating layer can be used. The coating layer(s) may be applied by any suitable method known to those of ordinary skill in the art. For example, the coating layer(s) may be applied to the golf ball cover by an in-mold coating process, such as described in U.S. Pat. No. 5,849,168, which is incorporated in its entirety by reference herein. The coating layer may have a thickness of about 0.004 inches or less, more preferably about 0.002 inches or less.

In addition, the golf balls of the invention may be painted or coated with an ultraviolet curable/treatable ink, by using the methods and materials disclosed in U.S. Pat. Nos. 6,500,495, 6,248,804, and 6,099,415, the entire disclosures of which are incorporated by reference herein.

In addition, trademarks or other indicia may be stamped, i.e., pad-printed, on the outer surface of the ball cover, and the stamped outer surface is then treated with at least one clear coat to give the ball a glossy finish and protect the indicia stamped on the cover.

The golf balls of the invention may also be subjected to dye sublimation, wherein at least one golf ball component is subjected to at least one sublimating ink that migrates at a depth into the outer surface and forms an indicia. The at least one sublimating ink preferably includes at least one of an azo dye, a nitroarylamine dye, or an anthraquinone dye. U.S. Patent Publication No. 20030106442, the entire disclosure of which is incorporated by reference herein.

Laser marking of a selected surface portion of a golf ball causing the laser light-irradiated portion to change color is also contemplated for use with the present invention. U.S. Pat. Nos. 5,248,878 and 6,075,223 generally disclose such methods, the entire disclosures of which are incorporated by reference herein. In addition, the golf balls may be subjected to ablation, i.e., directing a beam of laser radiation onto a portion of the cover, irradiating the cover portion, wherein the irradiated cover portion is ablated to form a detectable mark, wherein no significant discoloration of the cover portion results therefrom. Ablation is discussed in U.S. Pat. No. 6,462,303, which is incorporated in its entirety by reference herein.

Golf Ball Properties

The properties such as hardness, modulus, core diameter, intermediate layer thickness and cover layer thickness of the golf balls of the present invention have been found to effect play characteristics such as spin, initial velocity and feel of the present golf balls. For example, the flexural and/or tensile modulus of the intermediate layer are believed to have an effect on the "feel" of the golf balls of the present invention. It should be understood that the ranges herein are meant to be intermixed with each other, i.e., the low end of one range may be combined with a high end of another range.

Component Dimensions

Dimensions of golf ball components, i.e., thickness and diameter, may vary depending on the desired properties. For the purposes of the invention, any layer thickness may be employed. Non-limiting examples of the various embodiments outlined above are provided here with respect to layer dimensions.

The present invention relates to golf balls of any size. While USGA specifications limit the size of a competition golf ball to more than 1.68 inches in diameter, golf balls of any size can be used for leisure golf play. The preferred diameter of the golf balls is from about 1.68 inches to about 1.8 inches. The more preferred diameter is from about 1.68 inches to about 1.76 inches. A diameter of from about 1.68 inches to about 1.74 inches is most preferred, however diameters anywhere in the range of from 1.7 to about 1.95 inches can be used. Preferably, the overall diameter of the core and all intermediate layers is about 80 percent to about 98 percent of the overall diameter of the finished ball.

The core may have a diameter ranging from about 0.09 inches to about 1.65 inches. In one embodiment, the diameter of the core of the present invention is about 1.2 inches to about 1.630 inches. In another embodiment, the diameter of the core is about 1.3 inches to about 1.6 inches, preferably from about 1.39 inches to about 1.6 inches, and more preferably from about 1.5 inches to about 1.6 inches. In yet another embodiment, the core has a diameter of about 1.55 inches to about 1.65 inches.

The core of the golf ball may also be extremely large in relation to the rest of the ball. For example, in one embodiment, the core makes up about 90 percent to about 98 percent of the ball, preferably about 94 percent to about 96 percent of the ball. In this embodiment, the diameter of the core is preferably about 1.54 inches or greater, preferably about 1.55 inches or greater. In one embodiment, the core diameter is about 1.59 inches or greater. In another embodiment, the diameter of the core is about 1.64 inches or less.

When the core includes an inner core layer and an outer core layer, the inner core layer is preferably about 0.9 inches or greater and the outer core layer preferably has a thickness of about 0.1 inches or greater. In one embodiment, the inner core layer has a diameter from about 0.09 inches to about 1.2 inches and the outer core layer has a thickness from about 0.1 inches to about 0.8 inches. In yet another embodiment, the inner core layer diameter is from about 0.095 inches to about 1.1 inches and the outer core layer has a thickness of about 0.20 inches to about 0.03 inches.

The cover typically has a thickness to provide sufficient strength, good performance characteristics, and durability. The thickness of the outer cover layer may be from about 0.005 inches to about 0.100 inches, preferably about 0.007 inches to about 0.035 inches. In one embodiment, the cover thickness is from about 0.02 inches to about 0.35 inches. In another embodiment, the cover preferably has a thickness of about 0.02 inches to about 0.12 inches, preferably about 0.1 inches or less, more preferably about 0.07 inches or less. In yet another embodiment, the outer cover has a thickness from about 0.02 inches to about 0.07 inches. In still another embodiment, the cover thickness is about 0.05 inches or less, preferably from about 0.02 inches to about 0.05 inches. For example, the outer cover layer may be between about 0.02 inches and about 0.045 inches, preferably about 0.025 inches to about 0.04 inches thick. In one embodiment, the outer cover layer is about 0.03 inches thick.

The range of thicknesses for an intermediate layer of a golf ball is large because of the vast possibilities when using an intermediate layer, i.e., as an outer core layer, an inner cover layer, a wound layer, a moisture/vapor barrier layer. When used in a golf ball of the invention, the intermediate layer, or inner cover layer, may have a thickness about 0.3 inches or less. In one embodiment, the thickness of the intermediate layer is from about 0.002 inches to about 0.1 inches, preferably about 0.01 inches or greater. In one embodiment, the thickness of the intermediate layer is about 0.09 inches or less, preferably about 0.06 inches or less. In another embodiment, the intermediate layer thickness is about 0.05 inches or less, more preferably about 0.01 inches to about 0.045 inches. In one embodiment, the intermediate layer, thickness is about 0.02 inches to about 0.04 inches. In another embodiment, the intermediate layer thickness is from about 0.025 inches to about 0.035 inches. In yet another embodiment, the thickness of the intermediate layer is about 0.035 inches thick. In still another embodiment, the inner cover layer is from about 0.03 inches to about 0.035 inches thick. Varying combinations of these ranges of thickness for the intermediate and outer cover layers may be used in combination with other embodiments described herein.

The ratio of the thickness of the intermediate layer to the outer cover layer is preferably about 10 or less, preferably from about 3 or less. In another embodiment, the ratio of the thickness of the intermediate layer to the outer cover layer is about 1 or less.

Hardness

Most golf balls consist of layers having different hardnesses, e.g., hardness gradients, to achieve desired performance characteristics. The present invention contemplates golf balls having hardness gradients between layers, as well as those golf balls with layers having the same hardness.

It should be understood, especially to one of ordinary skill in the art, that there is a fundamental difference between "material hardness" and "hardness, as measured directly on a golf ball." Material hardness is defined by the procedure set forth in ASTM-D2240 and generally involves measuring the hardness of a flat "slab" or "button" formed of the material of which the hardness is to be measured. Hardness, when measured directly on a golf ball (or other spherical surface) is a completely different measurement and, therefore, results in a different hardness value. This difference results from a number of factors including, but not limited to, ball construction (i.e., core type, number of core and/or cover layers, etc.), ball (or sphere) diameter, and the material composition of adjacent layers. It should also be understood that the two measurement techniques are not linearly related and, therefore, one hardness value cannot easily be correlated to the other.

The cores of the present invention may have varying hardnesses depending on the particular golf ball construction. In one embodiment, the core hardness is at least about 15 Shore A, preferably about 30 Shore A, as measured on a formed sphere. In another embodiment, the core has a hardness of about 50 Shore A to about 90 Shore D. In yet another embodiment, the hardness of the core is about 80 Shore D or less. Preferably, the core has a hardness about 30 to about 65 Shore D, and more preferably, the core has a hardness about 35 to about 60 Shore D.

The intermediate layer(s) of the present invention may also vary in hardness depending on the specific construction of the ball. In one embodiment, the hardness of the intermediate layer is about 30 Shore D or greater. In another embodiment, the hardness of the intermediate layer is about 90 Shore D or less, preferably about 80 Shore D or less, and more preferably about 70 Shore D or less. In yet another embodiment, the hardness of the intermediate layer is about 50 Shore D or greater, preferably about 55 Shore D or greater. In one embodiment, the intermediate layer hardness is from about 55 Shore D to about 65 Shore D. The intermediate layer may also be about 65 Shore D or greater.

When the intermediate layer is intended to be harder than the core layer, the ratio of the intermediate layer hardness to the core hardness preferably about 2 or less. In one embodiment, the ratio is about 1.8 or less. In yet another embodiment, the ratio is about 1.3 or less.

As with the core and intermediate layers, the cover hardness may vary depending on the construction and desired characteristics of the golf ball. The ratio of cover hardness to inner ball hardness is a primary variable used to control the aerodynamics of a ball and, in particular, the spin of a ball. In general, the harder the inner ball, the greater the driver spin and the softer the cover, the greater the driver spin.

For example, when the intermediate layer is intended to be the hardest point in the ball, e.g., about 50 Shore D to about 75 Shore D, the cover material may have a hardness of about 20 Shore D or greater, preferably about 25 Shore D or greater, and more preferably about 30 Shore D or greater, as measured on the slab. In another embodiment, the cover itself has a hardness of about 30 Shore D or greater. In particular, the cover may be from about 30 Shore D to about 70 Shore D. In one embodiment, the cover has a hardness of about 40 Shore D to about 65 Shore D, and in another embodiment, about 40 Shore to about 55 Shore D. In another aspect of the invention, the cover has a hardness less than about 45 Shore D, preferably less than about 40 Shore D, and more preferably about 25 Shore D to about 40 Shore D. In one embodiment, the cover has a hardness from about 30 Shore D to about 40 Shore D.

In this embodiment when the outer cover layer is softer than the intermediate layer or inner cover layer, the ratio of the Shore D hardness of the outer cover material to the intermediate layer material is about 0.8 or less, preferably about 0.75 or less, and more preferably about 0.7 or less. In another embodiment, the ratio is about 0.5 or less, preferably about 0.45 or less.

In yet another embodiment, the ratio is about 0.1 or less when the cover and intermediate layer materials have hardnesses that are substantially the same. When the hardness differential between the cover layer and the intermediate layer is not intended to be as significant, the cover may have a hardness of about 55 Shore D to about 65 Shore D. In this embodiment, the ratio of the Shore D hardness of the outer cover to the intermediate layer is about 1.0 or less, preferably about 0.9 or less.

In another embodiment, the cover layer is harder than the intermediate layer. In this design, the ratio of Shore D hardness of the cover layer to the intermediate layer is about 1.33 or less, preferably from about 1.14 or less.

Compression

Compression values are dependent on the diameter of the component being measured. Atti compression is typically used to measure the compression of a golf ball. As used herein, the terms "Atti compression" or "compression" are defined as the deflection of an object or material relative to the deflection of a calibrated spring, as measured with an Atti Compression Gauge, that is commercially available from Atti Engineering Corp. of Union City, N.J.

The Atti compression of the core, or portion of the core, of golf balls prepared according to the invention is preferably less than about 80, more preferably less than about 75. In another embodiment, the core compression is from about 40 to about 80, preferably from about 50 to about 70. In yet another embodiment, the core compression is preferably below about 50, and more preferably below about 25. In an alternative, low compression embodiment, the core has a compression less than about 20, more preferably less than about 10, and most preferably, 0. As known to those of ordinary skill in the art, however, the cores generated according to the present invention may be below the measurement of the Atti Compression Gauge.

In one embodiment, golf balls of the invention preferably have an Atti compression of about 55 or greater, preferably from about 60 to about 120. In another embodiment, the Atti compression of the golf balls of the invention is at least about 40, preferably from about 50 to 120, and more preferably from about 60 to 100. In yet another embodiment, the compression of the golf balls of the invention is about 75 or greater and about 95 or less. For example, a preferred golf ball of the invention may have a compression from about 80 to about 95.

Initial Velocity and COR

There is currently no USGA limit on the COR of a golf ball, but the initial velocity of the golf ball cannot exceed 250±5 feet/second (ft/s). Thus, in one embodiment, the initial velocity is about 245 ft/s or greater and about 255 ft/s or greater. In another embodiment, the initial velocity is about 250 ft/s or greater. In one embodiment, the initial velocity is about 253 ft/s to about 254 ft/s. In yet another embodiment, the initial velocity is about 255 ft/s. While the current rules on initial velocity require that golf ball manufacturers stay within the limit, one of ordinary skill in the art would appreciate that the golf ball of the invention would readily convert into a golf ball with initial velocity outside of this range. For example, a golf ball of the invention may be designed to have an initial velocity of about 220 ft/s or greater, preferably about 225 ft/s or greater.

As a result, of the initial velocity limitation set forth by the USGA, the goal is to maximize COR without violating the 255 ft/s limit. The COR of a ball is measured by taking the ratio of the outbound or rebound velocity to the incoming or inbound velocity. In a one-piece solid golf ball, the COR will depend on a variety of characteristics of the ball, including its composition and hardness. For a given composition, COR will generally increase as hardness is increased. In a two-piece solid golf ball, e.g., a core and a cover, one of the purposes of the cover is to produce a gain in COR over that of the core. When the contribution of the core to high COR is substantial, a lesser contribution is required from the cover. Similarly, when the cover contributes substantially to high COR of the ball, a lesser contribution is needed from the core.

The present invention contemplates golf balls having CORs from about 0.700 to about 0.850 at an inbound velocity of about 125 ft/sec. In one embodiment, the COR is about 0.750 or greater, preferably about 0.780 or greater. In another embodiment, the ball has a COR of about 0.800 or greater. In yet another embodiment, the COR of the balls of the invention is about 0.800 to about 0.815.

In addition, the inner ball preferably has a COR of about 0.780 or more. In one embodiment, the COR is about 0.790 or greater.

Flexural Modulus

Accordingly, it is preferable that the golf balls of the present invention have an intermediate layer with a flexural modulus of about 500 psi to about 500,000 psi according to ASTM D-6272-98. More preferably, the flexural modulus of the intermediate layer is about 1,000 psi to about 250,000 psi. Most preferably, the flexural modulus of the intermediate layer is about 2,000 psi to about 200,000 psi.

The flexural modulus of the cover layer is preferably about 2,000 psi or greater, and more preferably about 5,000 psi or greater. In one embodiment, the flexural modulus of the cover is from about 10,000 psi to about 150,000 psi. More preferably, the flexural modulus of the cover layer is about 15,000 psi to about 120,000 psi. Most preferably, the flexural modulus of the cover layer is about 18,000 psi to about 110,000 psi. In another embodiment, the flexural modulus of the cover layer is about 100,000 psi or less, preferably about 80,000 or less, and more preferably about 70,000 psi or less. For example, the flexural modulus of the cover layer may be from about 10,000 psi to about 70,000 psi, from about 12,000 psi to about 60,000 psi, or from about 14,000 psi to about 50,000 psi.

In one embodiment, when the cover layer has a hardness of about 50 Shore D to about 60 Shore D, the cover layer preferably has a flexural modulus of about 55,000 psi to about 65,000 psi.

In one embodiment, the ratio of the flexural modulus of the intermediate layer to the cover layer is about 0.003 to about 50. In another embodiment, the ratio of the flexural modulus of the intermediate layer to the cover layer is about 0.006 to about 4.5. In yet another embodiment, the ratio of the flexural modulus of the intermediate layer to the cover layer is about 0.11 to about 4.5.

In one embodiment, the compositions of the invention are used in a golf ball with multiple cover layers having essentially the same hardness, but differences in flexural moduli. In this aspect of the invention, the difference between the flexural moduli of the two cover layers is preferably about 5,000 psi or less. In another embodiment, the difference in flexural moduli is about 500 psi or greater. In yet another embodiment, the difference in the flexural moduli between the two cover layers, wherein at least one is reinforced is about 500 psi to about 10,000 psi, preferably from about 500 psi to about 5,000 psi. In one embodiment, the difference in flexural moduli between the two cover layers formed of unreinforced or unmodified materials is about 1,000 psi to about 2,500 psi.

EXAMPLES

The following examples are only representative of the methods and materials for use in golf ball compositions and golf balls of this invention, and are not to be construed as limiting the scope of the invention in any way.

Example 1

Compositions of the invention may be formed according to the formulations in Tables 1 and 2 below.

TABLE 1

Dipolymer According to the Invention

| Compounding Ingredient | Amount (phr) |
|---|---|
| Polyacrylate Rubber | 100 |
| Peroxide | 1-5 |
| Stearic Acid | 0.5-2.0 |
| Amine Antioxidant | 0.5 |
| Magnesium Oxide | 5.0 |
| Coagent | 1 to 20 |

TABLE 2

Terpolymer According to the Invention

| Compounding Ingredient | Amount (phr) | | | | |
|---|---|---|---|---|---|
| Polyacrylate Rubber | 100 | 100 | 100 | 100 | 100 |
| Diamine | 1-5 | 1-2 | 1-2 | 3-5 | 3-5 |
| Accelerator | 4 | 0-4 | 0-4 | 0-4 | 0-4 |
| Antioxidant | 0.1-2 | 0.1-2 | 0.1-2 | 0.1-2 | 0.1-2 |
| Processing Aid | 0.5-3 | 0.5-3 | 0.5-3 | 0.5-3 | 0.5-3 |
| Peroxide | — | — | 1-5 | — | 1-5 |
| Filler | 40-60 | 5-60 | 5-60 | 5-60 | 5-60 |
| Plasticizer | 10 | 10 | 10 | 10 | 10 |
| Coagent | — | — | 1-3 | — | 1-3 |

The ingredients may be first mixed on a Banbury mixer or 2-roll mixer at a temperature below the half-life temperature of the peroxide after which the rubber compound may be compression molded into a golf ball component, such as a core, at a temperature sufficient to crosslink the rubber. For example, Di-Cup® 40C, available from Geo Speciality Chemicals of Gibbstown, N.J., is normally processed at temperatures up to about 250° F. and cured at temperatures above 300° F.

The invention described and claimed herein is not to be limited in scope by the specific embodiments herein disclosed, since these embodiments are intended as illustrations of several aspects of the invention. Any equivalent embodiments are intended to be within the scope of this invention. For example, the compositions of the invention may also be used in golf equipment such as golf club grips, golf ball shoe inner and outer liners, and golf bag portions. Indeed, various modifications of the invention in addition to those shown and described herein will become apparent to those skilled in the art from the foregoing description. Such modifications are also intended to fall within the scope of the appended claims. All patents and patent applications cited in the foregoing text are expressly incorporate herein by reference in their entirety.

What is claimed is:

1. A golf ball comprising a core and a cover, wherein at least a portion of the golf ball comprises a polyacrylate rubber composition comprising:

a polyacrylate elastomer; and a cure system, wherein the cure system comprises a diamine and an accelerator;

wherein the polyacrylate elastomer comprises about 5 percent to about 30 weight percent $C_{1-3}$ acrylate, about 40 percent to about 70 weight percent $C_{4-8}$ acrylate, and about 20 percent to about 30 weight percent an acrylate with an alkoxyalkyl group having about 2 to about 12 carbon atoms based on the total weight of the polyacrylate elastomer.

2. The golf ball of claim 1, wherein the diamine is selected from the group consisting of hexamethylene carbamate, ethylene diamine, methyl isobutyl ketimine, and mixtures thereof.

3. The golf ball of claim 1, wherein the accelerator comprises di-orthotolyl guanidine, diphenyl guanidine, and mixtures thereof.

4. The golf ball of claim 1, wherein the cure system comprises hexamethylene carbamate and at least one of di-orthotolyl guanidine and diphenyl guanidine.

5. A golf ball comprising a core and a cover, wherein at least a portion of the golf ball comprises a polyacrylate rubber composition comprising:

a polyacrylate elastomer; and a cure system, wherein the cure system comprises a diamine, a peroxide, and a polybutadiene having a number average molecular weight of about 5000 or less.

6. The golf ball of claim 5, wherein the diamine is selected from the group consisting of hexamethylene carbamate, ethylene diamine, methyl isobutyl ketimine, and mixtures thereof.

7. The golf ball of claim 5, wherein the polyacrylate elastomer comprises a $C_{4-8}$ acrylate, a $C_{1-3}$ acrylate, and an acrylate with an alkoxyalkyl group having about 2 to about 12 carbon atoms.

8. The golf ball of claim 5, wherein the peroxide is present in an amount of about 1 part to about 5 parts per hundred parts of the composition.

9. The golf ball of claim 5, wherein the polybutadiene is present in an amount of about 5 parts or less per hundred parts of the composition, and wherein the polybutadiene has a number average molecular weight of about 500 to about 2000.

* * * * *